United States Patent [19]

Schwär

[11] Patent Number: 4,656,789

[45] Date of Patent: Apr. 14, 1987

[54] APPARATUS FOR GRINDING CYLINDRICAL WORKPIECES, ESPECIALLY INNER AND OUTER SURFACES OF RACE RINGS FOR BEARINGS

[75] Inventor: Rudolf Schwär, Wuppertal, Fed. Rep. of Germany

[73] Assignee: Rene Keller, Bern, Switzerland

[21] Appl. No.: 768,027

[22] Filed: Aug. 21, 1985

[30] Foreign Application Priority Data

Sep. 17, 1984 [CH] Switzerland ..... 4444/84

[51] Int. Cl.[4] ..... B24B 33/10

[52] U.S. Cl. ..... 51/105 R; 51/103 R; 51/237 R; 51/291

[58] Field of Search ..... 51/105 R, 103 R, 102, 51/290, 291, 2 G, 2 K, 236, 233, 105 VG, 103 C, 237 R; 279/1 L

[56] References Cited

U.S. PATENT DOCUMENTS 3,056,238 10/1962 Hahn ..... 51/236

3,874,128 4/1975 Ishii ..... 51/236

*Primary Examiner*—Robert P. Olszewski

*Assistant Examiner*—Maurina Rachuba

*Attorney, Agent, or Firm*—Karl F. Ross; Herbert Dubno

[57] ABSTRACT

The apparatus for grinding of the inner or the outer surface of an annular workpiece, especially a race ring for an antifriction bearing, includes a fixed holder for hydrodynamically centering the workpiece, a rotating driver, and a pressing device. A respective workpiece can be held by the holder and is pressed with one end face by the pressing device against the respective end face of the driver for coaxially rotating the workpiece and the driver. The pressing device includes a hydraulic cyliner/piston assembly, which can be pressed against the workpiece on the side which is opposite to the driver. The pressing device includes a pressing ring which is formed as an extension of the piston and which, via the respective workpiece, is rotatively driven by the driver. The pressing piston is arranged in a cylinder which is disposed coaxially with respect to the driver, but it is mounted fixedly in the machine so as not to rotate. The piston is disposed with an adjustment clearance in the piston chamber to allow access on both sides of the pressing piston of the respective hydraulic pressure medium.

1 Claim, 5 Drawing Figures

APPARATUS FOR GRINDING CYLINDRICAL WORKPIECES, ESPECIALLY INNER AND OUTER SURFACES OF RACE RINGS FOR BEARINGS

FIELD OF THE INVENTION

My present invention relates to an apparatus for grinding the inner and outer surfaces of cylindrical or similar annular workpieces and, more particularly, to such apparatus which can be used to position and retain antifriction bearing-race rings for grinding by a grinding tool.

BACKGROUND OF THE INVENTION

An apparatus for grinding the inner surface and/or the outer surface of an annular workpiece, especially the race rings for antifriction bearings can include a non-rotating holder which serves to position the annular workpiece for the grinding operation. The apparatus also includes a rotating driver which is powered to rotate about its axis, and further includes a pressing device which urges the workpiece ring against the driver.

The workpiece holder hydrodynamically centers the workpiece for the grinding operation while forming a fluid bearing on which it is journaled with the workpiece during such operation then being pressed at end face by the pressing device, against an end face of the rotating driver.

The workpiece and the rotating driver can thus be rotated or turned together, with the workpiece being coaxially aligned with respect to the rotating driver.

The pressing device can include a hydraulic pressing cylinder/piston assembly which acts against the workpiece on the side opposite to the driver, i.e. the workpiece is generally disposed between the pressing device and the driver.

The hydrodynamic centering holder for the workpiece, can include a holder shaft for grinding outer surfaces, or a holder bed or sleeve for the grinding of inner surfaces. The outer diameter of the holder shaft is smaller than the inner diameter of the workpiece, to create a centering or annular clearance gap. Similarly, the holder sleeve can have an inner diameter which is greater than the outer diameter of the workpiece, also to create an annular clearance.

The centering action is achieved by continuous introduction of a hydraulic pressure medium into the clearance. In general, the conventional grinding or cooling medium or liquid is also used as the hydraulic pressure medium for this centering or conversely this centering medium forms the grinding and cooling medium. The hydraulic pressure medium is introduced through corresponding bores or passages in the hydrodynamic centering holder.

OBJECTS OF THE INVENTION

It is accordingly an object of the invention to improve the apparatus of the type briefly discussed in the foregoing in such a way that the pressing device does not impart disrupting forces on the workpiece.

It is also an object of my present invention to improve the operation of the apparatus in such a way that workpieces are less subjected to disruptive forces or pressures.

It is still another object of the invention to provide an apparatus in which the machining accuracy can be increased.

SUMMARY OF THE INVENTION

These objects are attained in accordance with the invention in that the pressing device includes a pressing ring which is formed as a continuation or extension of a pressing piston. The pressing ring is rotated about its axis, via the respective workpiece, by the driver. The pressing or holding piston is arranged in a cylindrical formation or chamber of a respective cylinder or housing, and it extends substantially coaxially with respect to the driver. The cylinder is mounted fixedly in the apparatus. The piston is disposed in the cylindrical chamber with radial tolerance or clearance which allows passage or flow of the hydraulic pressure medium on both sides of the pressing piston.

A known apparatus of this type which is currently employed has found ready acceptance. The hydrodynamic centering holder precludes deformations which cause inaccuracies of the treated workpieces. These inaccuracies can arise with mechanical or magnetic holders.

In the known apparatus the pressing devices includes pressing rollers which, in turn, are journaled on pins or the like. These rollers have the size of a ball bearing. The pressing rollers are carried along by the rotating workpiece and rotate about an axis which is positioned orthogonally with respect to the axis of rotation of the respective workpiece.

In the known apparatus the pressing device does not operate without application of stress to the workpiece. The pressing rollers, therefore, can create boundary conditions with respect to the movement of the workpiece which can and do affect the kinematics and dynamics of the operational situation or conditions.

In the sense of classical mechanics the workpiece moves on or in the workpiece holder and coaxially with respect to the driver like a spinning top or gyro, albeit under the influence of the tool. Thus, its rotational movement is stabilized. The pressing device, however, does not participate in the spinning motion and thus generates forces or conditions which interfere with or affect the accuracy of the operation.

In the apparatus according to the invention the pressing ring is rotatably driven by the driver—via the workpiece—to turn about its longitudinal central axis and, due to the described compensation clearance or adjustment tolerance, the pressing ring is also free to rotate with its piston, with a motion comparable to that of a spinning top or gyro. The workpiece and the pressing ring adjust to one another in a gyroscopic manner so that the disruptive forces or pressures do not arise. The machining accuracy is thus increased considerably in this manner.

In accordance with one preferred embodiment of the invention, the pressing device includes a cylindrical annular part, or pressing ring, and further includes a pressing piston which extends with an annular collar radially beyond the pressing ring.

In accordance with another aspect of the invention I have found that a sufficiently large compensating clearance is provided and assured when the pressing piston is disposed in the associated cylindrical chamber so as to leave a clearance which is sufficiently large to allow passage of the hydraulic pressure medium. Thus, the hydraulic pressure medium can surround or immerse the pressing piston in the region of the clearance gap.

In general, one will use a conventional grinding and cooling medium as hydraulic pressure medium in the apparatus or conversely a pressure medium suitable as a grinding liquid.

The hydrodynamically centering holder can be formed as has been practiced in the past in the apparatus according to the invention. Thus, the holder need not directly interact with the pressing ring.

On the other hand, I have found it to be advantageous to extend the holder in the direction of the pressing device, the extension being then designed to also perform the functions of the hydrodynamically centering holder for the pressing ring. The pressing ring, in turn, can be introduced into the extension, or it can be mounted thereon. The extension piece accordingly acts, as it were, a sleeve also on the pressing ring, but it does not detrimentally affect the described compensating clearance.

In accordance with the invention, the apparatus can be used to grind conventional rings for antifriction bearings, and the hydrodynamic centering holder for the workpiece and the pressing ring, the latter as required, have a centering clearance of about three one-hundredths of a millimeter. The compensating clearance of the pressing piston on both sides of the pressing piston towards the cylinder is approximately five one-hundredths of a millimeter.

The apparatus according to the invention can be used for grinding the inner surface as well as for grinding of the outer surface of an annular workpiece. In the embodiment which is used for grinding inner surfaces of an annular workpiece, it is preferred that the pressing piston is in the form of an annular piston, and the grinding tool can reach through the annular piston into the hydrodynamic centering holder.

In the embodiment which is intended for grinding of the outer surface of an annular workpiece the pressing piston can be a substantially solid piston.

DESCRIPTION OF THE DRAWING

The above and other objects, features and advantages will become apparent from the following description, reference being made to the accompanying drawing in which.

SPECIFIC DESCRIPTION

Figure 1:
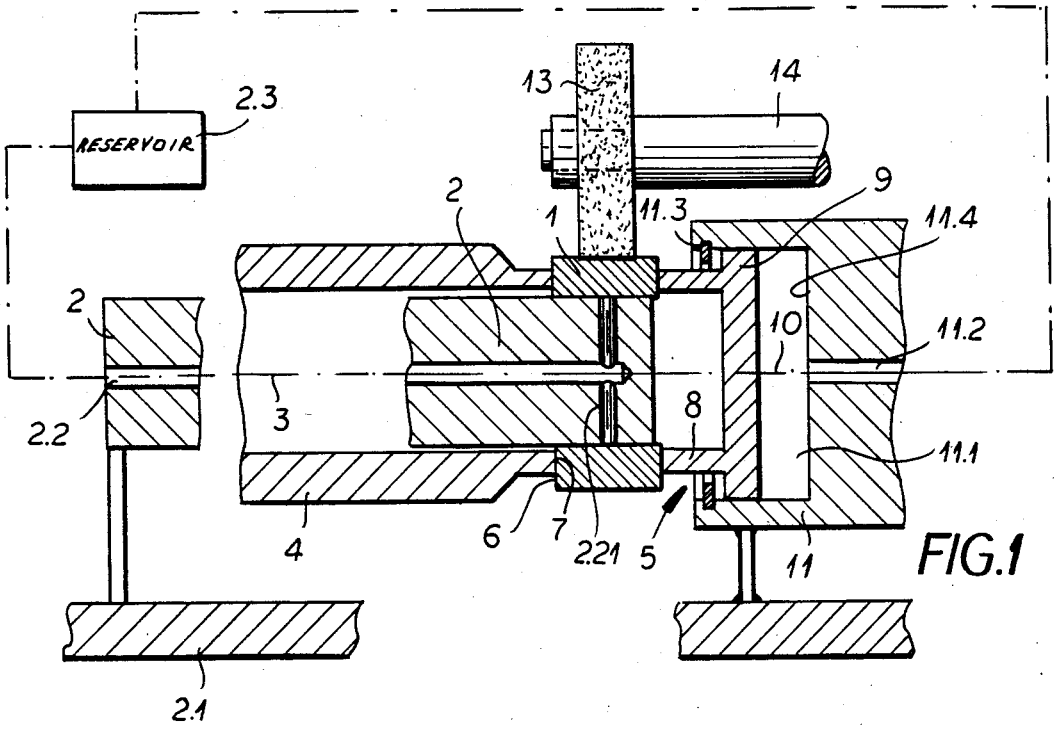
FIG. 1 is an axial cross section through an apparatus for grinding the outer surface of a race ring.

The apparatus shown in the drawing figures is intended for the grinding of the inner surface, or the outer surface, of an annular workpiece 1, especially the race rings for antifriction bearings.

The basic components of the apparatus include a non-rotating workpiece holder 2 which is secured to the base or housing 2.1 of the apparatus, a driver 4 which is mounted so as to rotate about its axis 3, and a pressing device 5.

The workpiece holder 2 is adapted to hydrodynamically center the annular workpiece 1. Thus, a workpiece 1 is arranged on the non-rotating holder 2 and it is pressed with its left end face 6, by way of the pressing device 5, against the end face 7 of the driver The pressing device 5 includes a hydraulic pressing cylinder/piston assembly which is mounted in such a way that it can act on the workpiece on the side which is opposite to that of the driver 4.

The pressing device 5 operates with a pressing ring 8 which is a continuation of the pressing piston 9, and this pressing ring 8 can be driven—by way of the annular workpiece 1—by the driver 4 to rotate about its longitudinal central axis 10.

Figure 4A:
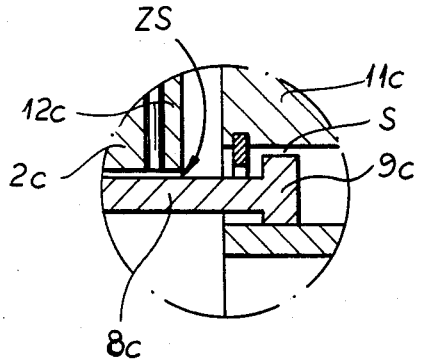
FIG. 4A shows at a larger scale the region in circle IVA in FIG. 4.

The pressing piston 9 is disposed in a cylinder generally identified by reference numeral 11. The cylinder 11 extends coaxially with respect to the driver 4 and is mounted in the apparatus so as not to rotate. However, as indicated in FIG. 4A, a clearance S is provided between the outer wall or surface of the pressing piston 9 and the adjacent wall or surface of thr cylinder 11. This annular clearance or gap S allows transfer of hydraulic pressure medium from one side of the piston 9 to the other. In this manner the clearance S allows coaxial alignment of the pressing ring 8 with respect to the annular workpiece 1, by means of the described spinning-top or gyro effect, and also with respect to the driver 4.

Preferably the pressing ring 8 is a cylindrical annular piece or annulus, and the pressing piston 9 extends in the form of an annular collar radially beyond the annulus. The pressing piston 9 is arranged in the cylinder 11 with a clearance gap S, and the hydraulic pressure medium immerses the piston 9 and can flow from one side to the other. This is diagrammatically indicated at an enlarged scale in the circle in FIG. 4A. The conventional grinding and cooling medium is used as hydraulic pressure medium.

Figure 2:
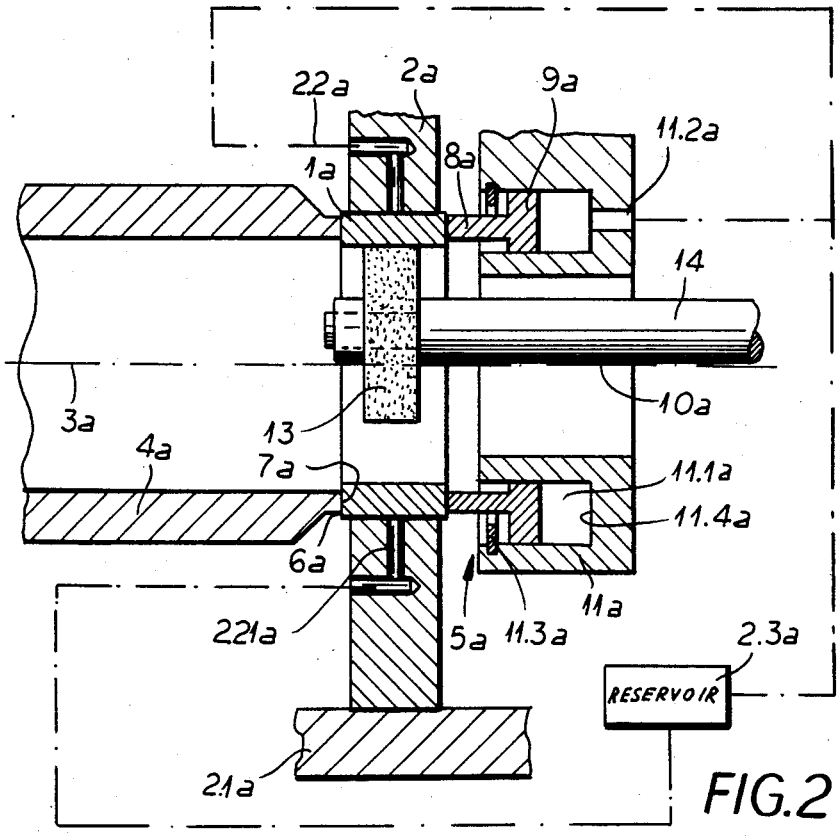
FIG. 2 is an axial cross section through the apparatus for grinding the inner surface of a race ring.

In the embodiment of the apparatus shown in FIGS. 1 and 2, no use is made of a direct interface relationship between the pressing cylinder 11 and the hydrodynamically centering holder 2.

More specifically, the embodiment shown in FIG. 1 is intended for the grinding of the outer surface of an annular workpiece 1, especially the race rings for antifriction bearings.

The apparatus of FIG. 1 includes the non-rotating workpiece holder 2 in the form of a shaft which is secured to the base or housing 2.1 of the apparatus. This holder 2 is coaxially disposed in the hollow driver 4 which is mounted so as to rotate about the longitudinal central axis 3. The pressing device 5 is provided adjacent to the workpiece 1 and in operative contact therewith.

The holder 2 has a longitudinal central bore 2.2 as well as one or several transverse bores or passages 2.21 which are in communication with one another, and which allow passage of a pressure medium from a source 2.3 such as a pump to the workpiece 1, for hydrodynamically centering the workpiece 1. Thus, the respective workpiece 1 is arranged on the shaft or holder 2, and it is pressed with its left end face 6 against the end face 7 of the driver 4 by the pressing device 5. As mentioned, the pressing ring 8 can be driven, by way of the workpiece 1, by the driver 4 to rotate about its longitudinal central axis 10. The workpiece 1 is accordingly driven, i.e. rotated, by the driver 4 in a coaxial manner with respect to the longitudinal central axis 3. The medium which leaks past the hydrodynamic centering and journaling clearances is collected and, after filtering, can be returned to the pump.

The pressing device 5 in FIG. 1 includes a hydraulic pressing cylinder/piston assembly comprised of the cylinder part 11 which has a cylindrical chamber 11.1 for the reciprocatingly arranged pressing piston 9. Thus, when the ring or annulus 8 is rotated, the pressing piston 9 can also be driven by way of the workpiece 1 from the driver 4 to rotate about the longitudinal central axis 10.

The cylindrical chamber 11.1 communicates with the reservoir 2.3 by way of the passage or bore 11.2 and other commonly known duct means (not shown in detail). The movement of the pressing piston 9 in the chamber or cylindrical formation 11.1 is limited in forward direction by a snap-ring 11.3 or the like element, and in rearward direction by the wall 11.4 of the cylindrical chamber 11.1.

The embodiment shown in FIG. 2 is particularly intended for the grinding of the inner surface of an annular workpiece 1*a*, especially the race rings for antifriction bearings.

The apparatus of FIG. 2 includes the fixed workpiece holder 2*a* in the form of a mounting ring or bed which is secured to the base or housing 2.1*a* of the apparatus. The workpiece 1a is mounted in the holder 2*a* which is substantially coaxially disposed with respect to the hollow driver 4*a* which is mounted so as to rotate about the longitudinal central axis 3*a*. The pressing device 5*a* is provided adjacent to the workpiece 1*a* and in operative contact therewith.

The holder 2*a* has axially extending bores 2.2*a* as well as radially extending bores 2.21*a* which are in communication with one another and which allow passage of a pressure medium from a reservoir 2.3*a* to the workpiece 1*a*, for hydrodynamically centering the workpiece 1*a*. Thus, the respective workpiece 1*a* is hydrodynamically arranged in the holder 2*a*, and it is pressed with its left end face 6*a* against the end face 7*a* of the driver 4*a* by the pressing device 5*a*. As mentioned, the pressing ring 8*a* can be driven, by way of the workpiece 1*a*, by the driver 4*a* to rotate about its longitudinal central axis 10*a*. The workpiece 1*a* is accordingly driven, i.e. rotated, by the driver 4*a* in a coaxial manner with respect to the axis 3*a*.

The pressing device 5*a* in FIG. 2 includes a hydraulic pressing cylinder/piston assembly comprised of the cylinder part 11a which has an annular cylindrical chamber 11.1*a* for the reciprocatingly arranged pressing piston 9*a*. Thus, when the ring or annulus 8*a* is rotated, the piston 9*a* can also be driven by way of the workpiece 1*a* from the driver 4*a* to rotate about the longitudinal central axis 10*a*.

The annular cylindrical chamber 11.1*a* communicates with the reservoir 2.3*a* by way of the passage or bore 11.2*a* and other commonly known duct means (not shown in detail). The reciprocating movement of the piston 9*a* in the annular chamber or cylindrical formation 11.1*a* is limited in forward direction by a snap-ring 11.3*a* or the like element, and in rearward direction by the wall 11.4*a* of the annular cylindrical chamber 11.1*a*.

Figure 3:
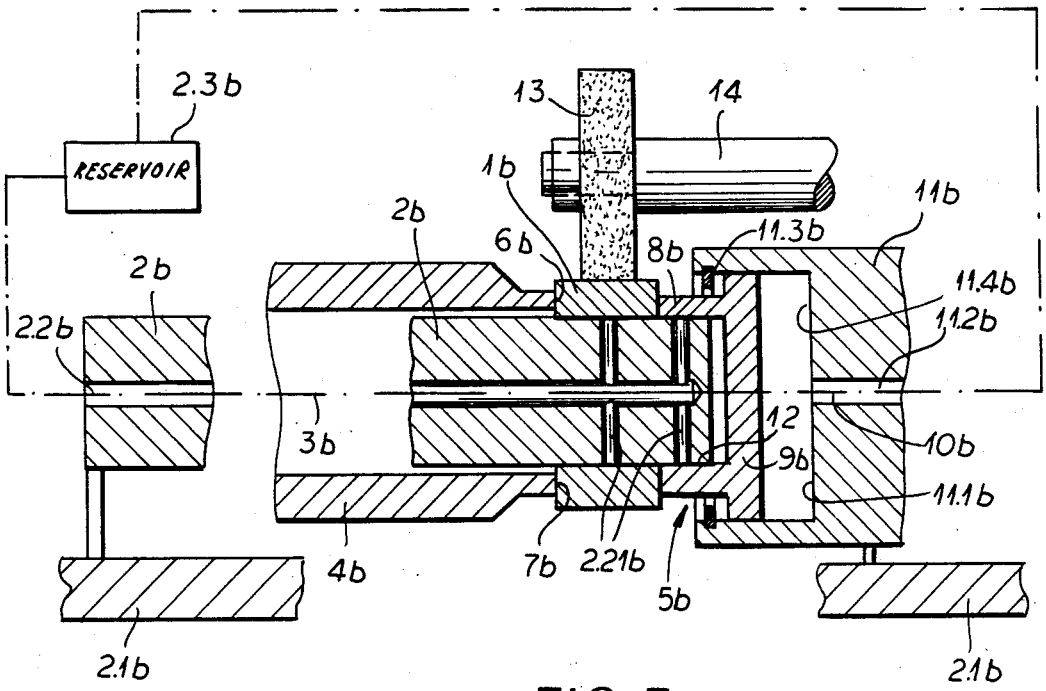
FIG. 3 is a further axial cross section illustrating another embodiment of an apparatus for grinding the outer surface of a race ring for an antifriction bearing.
Figure 4:
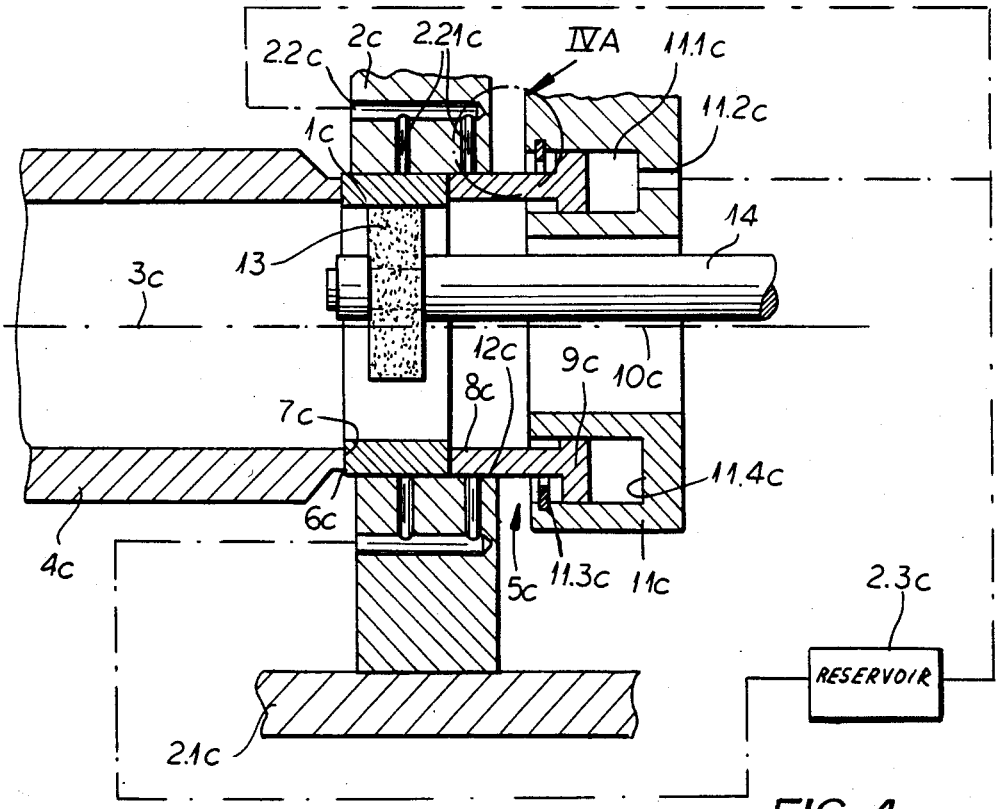
FIG. 4 is also an axial cross section illustrating another embodiment of an apparatus for grinding the inner surface of a race ring.

While in the embodiments shown in FIGS. 1 and 2, no use is made of a special interrelationship between the pressing cylinder 11 and the hydrodynamically centering holder 2, in the embodiments according to FIGS. 3 and 4, the hydrodynamically centering holder 2 is extended the direction of the pressing device 5 to directly interact with the pressing piston 9.

The embodiment shown in FIG. 3 is also intended for the grinding of the outer surface of an annular workpiece 1*b*, especially the race rings for antifriction bearings.

The apparatus shown in FIG. 3 includes the fixed workpiece holder 2*b* in the form of a shaft. The workpiece 1*b* is mounted in the holder 2*b* which is substantially coaxially disposed with respect to the hollow driver 4*b* which is mounted so as to rotate about the axis 3*b*. The pressing device 5*b* is provided adjacent to the workpiece 1*b* and in operative contact therewith.

The shaft or holder 2*b* has a longitudinal central bore 2.2*b* as well as two transverse bores or passages 2.21*b* which are in communication with one another and which allow passage of a pressure medium from a reservoir 2.3*b* to the workpiece 1*b*, for hydrodynamically centering this workpiece 1*b* on the shaft or holder 2*b*. The workpiece 1*b* is pressed with its left end face 6*b* against the end face 7*b* of the hollow driver 4*b* by the pressing device 5*b*. The associated pressing ring 8*b* can be driven, by way of the workpiece 1*b*, by the driver 4*b* to rotate about its longitudinal central axis 10*b*. The workpiece 1*b* is also driven, i.e. rotated, by the hollow driver 4*b* in coaxial manner about the axis 3*b*.

The pressing device 5*b* in FIG. 3 includes a hydraulic pressing cylinder/piston assembly comprised of the cylinder part 11*b* which has a cylindrical chamber 11.1*b* for the reciprocatingly arranged pressing piston 9*b*. Thus, when the ring or annulus 8*b* is rotated, the piston 9*b* can also be driven by way of the workpiece 1*b* from the driver 4*b* to rotate about the longitudinal central axis 10*b*.

The cylindrical chamber 11.1*b* communicates with the reservoir 2.3*b* by way of the passage or bore 11.2*b* and other commonly known duct means (not shown in detail). The movement of the piston 9*b* in the chamber or cylindrical formation 11.1*b* is limited in forward direction by a snap-ring 11.3*b*, or the like element, and in rearward direction by the wall 11.4*b* of the cylindrical chamber 11.1*b*.

The apparatus of FIG. 4 includes the fixed workpiece holder 2*c* in the form of a mounting ring or bed which is secured to the base or housing 2.1*c* of the apparatus. The workpiece 1*c* is mounted in the holder 2*c* which is substantially coaxially disposed with respect to the hollow driver 4*c* which is mounted so as to rotate about the axis 3*c*. The pressing device 5*c* is provided adjacent to the workpiece 1*c* and is adapted to be in operative contact therewith.

The holder 2*c* has axially extending bores 2.2*c* as well as radially extending bores 2.21*c* which are in communication with one another and which allow passage of a pressure medium from a reservoir 2.3*c* to the workpiece 1*c*, for hydrodynamically centering the workpiece 1*c*. Thus, the respective workpiece 1*c* is hydrodynamically arranged in the holder 2*c*, and it is pressed with its left end face 6*c* against the end face 7*c* of the driver 4*c* by the pressing device 5*c*. As mentioned, the pressing ring 8*c* can be driven, by way of the workpiece 1*c*, by the driver 4*c* to rotate about its longitudinal central axis 10*c*. The workpiece 1*c* is accordingly driven, i.e. rotated, together with the driver 4*c* in coaxial manner about axis 3*c*.

The annular chamber 11.1*c* communicates with the reservoir 2.3*c* by way of the passage or bore 11.2*c* and other commonly known duct means (not shown in detail). The movement of the piston 9*c* in the chamber or cylindrical formation 11.1*c* is also limited in forward direction by a snap-ring 11.3*c*, or the like element, and in rearward direction by the wall 11.4*c* of the cylindrical chamber 11.1*c*.

Thus, for grinding or similarly finishing outer surfaces, in the direction of the pressing device 5 a respective holder 2 has an extension piece 12 which is carrying out the functions of the hydraulic-centering holder 2 for the pressing ring 8, and the respective pressing ring 8 can be mounted on the extension piece 12 (FIG. 3) or can be inserted into the extension piece 12 (FIG. 4). The embodiment for the centering on the one hand and for the described compensation clearance S on the other hand, are geometrically arranged within limits which can due to scale not be represented in the customary patent drawings. The hydrodynamic-centering holder 2 for the workpiece 1, and, as required, the pressing ring 8 has, for example, a centering clearance ZS of 3/100 mm. The compensation clearance S of the pressing piston 9 should have on both sides towards the cylinder 11, approximately 500th of a millimeter.

In the embodiment for grinding the inner surfaces of workpieces 1 (compare FIGS. 2 and 4), the pressing piston 9 is in the form of an annular piston, and the grinding tool 13 can be passed through the annular piston into the respective hydrodynamic-centering holder 2. This tool 13 is mounted on a corresponding tool carrier or shaft 14 driven by a motor not shown.

In the embodiment for grinding the outer surfaces of an annular workpieces 1 (FIGS. 1 and 3) the pressing piston 9 is a substantially fully solid piston.

I claim:

1. A grinding apparatus for an annular workpiece, said apparatus comprising:

a stationary support base for said apparatus;

a driver in the form of a hollow cylinder mounted on said support base, said driver having an end face adapted to engage said workpiece at one side thereof and rotate said workpiece about a longitudinal axis;

a pressing device including:

a hydraulic pressing cylinder coaxial with said hollow cylinder, a piston adapted to press said workpiece against said driver, said piston being disposed in the hydraulic pressing cylinder with radial adjustment clearance which allows passage of a hydraulic pressure medium from one side of said piston to an opposite side of said piston, and a pressing ring formed as an extension of said piston and adapted to be rotatively driven by the workpiece;

a nonrotating workpiece holder provided with means for hydrodynamically centering said workpiece, said holder being spaced from said workpiece by a distance smaller than said clearance between said piston and said cylinder, said workpiece holder having a longitidunal bore and two transverse bores in communication with one another and wherein one of said two transverse bores is positioned orthogonal to said workpiece while a second of said two transverse bores is positioned orthogonal to said pressing ring; and a tool for grinding a peripheral surface of said workpiece.

* * * * *